United States Patent [19]

Dethier

[11] Patent Number: 5,069,146

[45] Date of Patent: Dec. 3, 1991

[54] GRATE FOR A FUEL BOILER

[75] Inventor: Louis Dethier, Waimes, Belgium

[73] Assignee: Teset A.G., Waimes, Belgium

[21] Appl. No.: 638,904

[22] Filed: Jan. 10, 1991

[30] Foreign Application Priority Data

Jan. 16, 1990 [DE] Fed. Rep. of Germany ..... 4000973

[51] Int. Cl.[5] ..... F23H 7/08; F23H 7/14

[52] U.S. Cl. ..... 110/281; 110/291; 110/298; 126/154; 126/175; 198/773

[58] Field of Search ..... 110/281, 291, 282, 283, 110/284, 298, 299, 300; 126/154, 174, 175; 198/773

[56] References Cited

U.S. PATENT DOCUMENTS 2,250,067 7/1941 Martin ..... 110/282
4,170,183 10/1979 Cross ..... 110/191 X
4,676,176 6/1987 Bonomelli ..... 110/281
4,884,516 12/1989 Linsen ..... 110/281

*Primary Examiner*—Edward G. Favors
*Attorney, Agent, or Firm*—Foley & Lardner

[57] ABSTRACT

A grate for a fuel boiler, consisting of plates arranged stepwise or in a cascading fashion, with at least two fixed plates and a movable plate disposed between the two fixed plates. The movable plate is capable of reciprocating to and fro and is provided with an appropriate drive. Combustion air passes through the interspace between the movable and fixed plates and allows for controlled and complete combustion of the fuel. The fixed plates are fastened to a common first holder and the movable plates are fastened to a common second holder. The fastening of each plate to its individual holder is vertically-adjustable. Preferably, the air utilized for combustion of the fuel is only that which has passed through, and preferably been drawn through, the interspace between the movable and fixed plates.

19 Claims, 4 Drawing Sheets

GRATE FOR A FUEL BOILER

BACKGROUND OF THE INVENTION

The present invention relates to a grate for a fuel boiler, consisting of plates arranged stepwise or in a cascading fashion, with at least two fixed plates and a third movable plate positioned therebetween. The third plate is movable to and fro and is provided with an appropriate drive. Combustion air passes through the interspace between the plates.

In combustion furnaces with continuous or intermittent fuel feed, the aim is the most complete combustion of the fuel possible, in order to minimize ash production. For this purpose, it is necessary to allow the fuel to remain on the grate for a relatively long time, in order to provide the burning time necessary for complete combustion. In order to create uniform combustion conditions, it is then necessary to transport the fuel from one end of the grate to the opposite end of the grate, so that fresh fuel can be resupplied to establish a reasonably uniform state. For the transport of the fuel from one end of the grate to the other, it is desirable that no fuel fraction can drop through the grate before reaching the ash-side end of the grate, since the fuel dropping through may not yet have been completely burned.

A typical grate of the type mentioned consists of fixed plates arranged stepwise, between each of which a plate movable to and fro is arranged. The movable plates are of hollow design and carry a water flow, which is intended to protect the plate material. Primary air for the combustion flows through the interspace between the movable and fixed plates, while secondary air can enter at the height of the fuel bed through lateral orifices in the boiler wall. Due to the movement of the movable plates of the grate, the fuel migrates down on the steps of the grate until it drops into an ash receiver at the lower end of the grate. The combustion in the firing chamber is assisted by a flame directed from a side wall of the boiler upon the grate, which flame is fed by another fuel, for example gas. In order to establish an air supply which is adapted to the fuel quality varying during the migration over the grate, various chambers are provided underneath the grate, into which combustion air can be blown at different rates, which air then exits through the respective interspace of the grate. A water-cooled heat shield arranged at an incline above the grate ensures relatively fast cooling of the combustion gases above the grate. The movable and fixed plates of the grate are arranged such that only one gap is formed between every two stationary plates, because one stationary plate and one fixed plate are in direct mutual contact in each case.

The known grate has numerous disadvantages. The use of primary and secondary air does not allow fully controlled combustion. The same applies to the water cooling of the movable grate plates, which does not permit complete combustion of a type of fuel which is difficult to burn, such as trash. Furthermore, the movable plates mounted on the fixed plates are subject to considerable wear, since solid fuel particles damage the surface thereof during the relative movement of the two superposed plates. A further disadvantage of the known grate is that the fuel drops down a slope upon the grate. It is therefore entirely a matter of chance how far the fuel cascades on the grate before it comes to a stop. It is clear that this results in widely different residence times of fuel particles on the grate.

The known boiler and grate arrangement therefore allows neither a complete nor adequately controlled combustion of the fuel. Furthermore, the known grate arrangement does not make possible a marked reduction in the pollutant content of the combustion gases.

SUMMARY OF THE INVENTION

It is therefore an object of the present invention to provide a grate or a boiler, which allows controlled and complete combustion of the fuel, particularly fuel which is difficult to burn, such as trash.

In order to achieve this object, the claimed grate includes a plurality of plates arranged in a cascading fashion, with at least two fixed plates of the grate fastened to a common first holder and a third movable plate fastened to a common second holder and disposed between each pair of fixed plates. Drive means are attached to the second holder for driving the movable plates to reciprocate between each pair of fixed plates. The fixed plates are vertically adjustable with respect the first common holder and the movable plates are vertically adjustable with respect to the second holder.

The vertical adjustability of the individual plates of the grate allows for different interspacing between each fixed and movable plate arrangement thereby providing for tailoring the passage of the combustion air through each interspace. Thus, the interspace can be tailored to the type of fuel undergoing combustion or can be adjusted to different heights over the length of the grate in order to produce a desired profile for the flow of combustion air through the grate. Under this scenario, the interspacing at the first end can be adjusted for less than stoichiometric carbonization, while the interspacing at the opposite end is adjustable for a more than stoichiometric complete combustion which takes place towards this end of the grate. For this purpose, the interspace between the plates would be enlarged towards the end of the grate.

According to one aspect of the invention, the grate according to the invention is designed such that the combustion takes place exclusively with the primary air passing through the plate interspace and that no secondary air is admitted. As a result of mounting the fixed plates on one holder and the movable plates on a separate holder, mounting of the adjacent fixed and movable plates independently of one another is accomplished. This dispenses with the necessity of letting plates of one type rest on plates of the other type, whereby considerable mechanical stresses are generated. According to another aspect of the invention, there are air gaps between a fixed plate and the two adjacent movable plates and between a movable plate and the two adjacent fixed plates. Because of the common holder for the movable plates, their drive for the to-and-fro movement can easily be implemented, by moving the complete holder to and fro.

Preferably, the movable plates are arranged such that they overlap both adjacent fixed plates even in their extreme positions of the to-and-fro movement. This prevents dropping of fuel through the grate.

In a preferred embodiment of simple design, the plates rest on vertically upright plate-like supports which are fitted to the common holders in a height-adjustable manner.

Defined feed of the fuel to the start of the grate is achieved, if a feed tray, arranged at the height of the start of the grate, is used as a device for feeding the fuel to the grate.

Further objects, features and advantages of the present invention will become apparent from the detailed description of preferred embodiments which follows, when considered together with the attached figures of drawing.

DETAILED DESCRIPTION OF THE PREFERRED EMBODIMENTS

The grate according to the present invention is designed such that the combustion takes place exclusively with the primary air passing through the plate interspace and that no secondary air is admitted. Because the fixed plates and movable plates are each mounted on their own common holder, mounting of the adjacent fixed and movable plates independently of one another is accomplished. This dispenses with the necessity of letting plates of one type rest on plates of the other type, whereby considerable mechanical stresses are generated.

The common second holder of the movable plates is preferably formed as a channel of approximately U-shaped cross-section, the vertically upright supports for the movable plates being fastened to the side walls thereof. The movable plates can be joined to the vertically upright supports by screwing.

Vertically upright plate-like supports joined to the common first holder have a stepped upper edge, whereby a recess is formed which receives the respective plate. The recess can hereby be open towards the support preceding in the direction of inclination, so that the fixing of the fixed plates is effected by two plate-like supports in mutual contact.

Preferably, the vertical supports are arranged to mutually adjoin one another tightly, and the supply of air is effected within the vertical supports. In this way, feeding of lateral secondary air can be reliably prevented.

The boiler and grate arrangement described above operates with combustion air which passes exclusively through the interspace between the plates. Preferably, the combustion air is moved through the interspace by a source of suction arranged downstream of the firing chamber. The firing chamber is thus under a reduced pressure which causes combustion air to be drawn through the interspace between the grate plates. Sharply defined combustion conditions can be set by means of the reduced pressure. It is particularly preferred here to maintain a low fuel bed temperature, which ensures that any acid formers bound by the addition of basic additives remain in the ash and do not decompose and pass into the gaseous state as a result of unduly high firing bed temperatures and contaminate the combustion gases as pollutants.

The boiler according to the invention can preferably be designed with an after-burning chamber, in which very high temperatures, which decompose any unbound pollutants thermally to give harmless gases, are generated as a result of radiant heat and good insulation. The boiler also operates without an additional flame since, due to the controlled fuel feed and due to the controlled transport on the grate, the fuel rate can be reliably controlled at any time, so that defined temperatures and combustion conditions can be achieved even with a fuel having widely varying properties.

Figure 1:
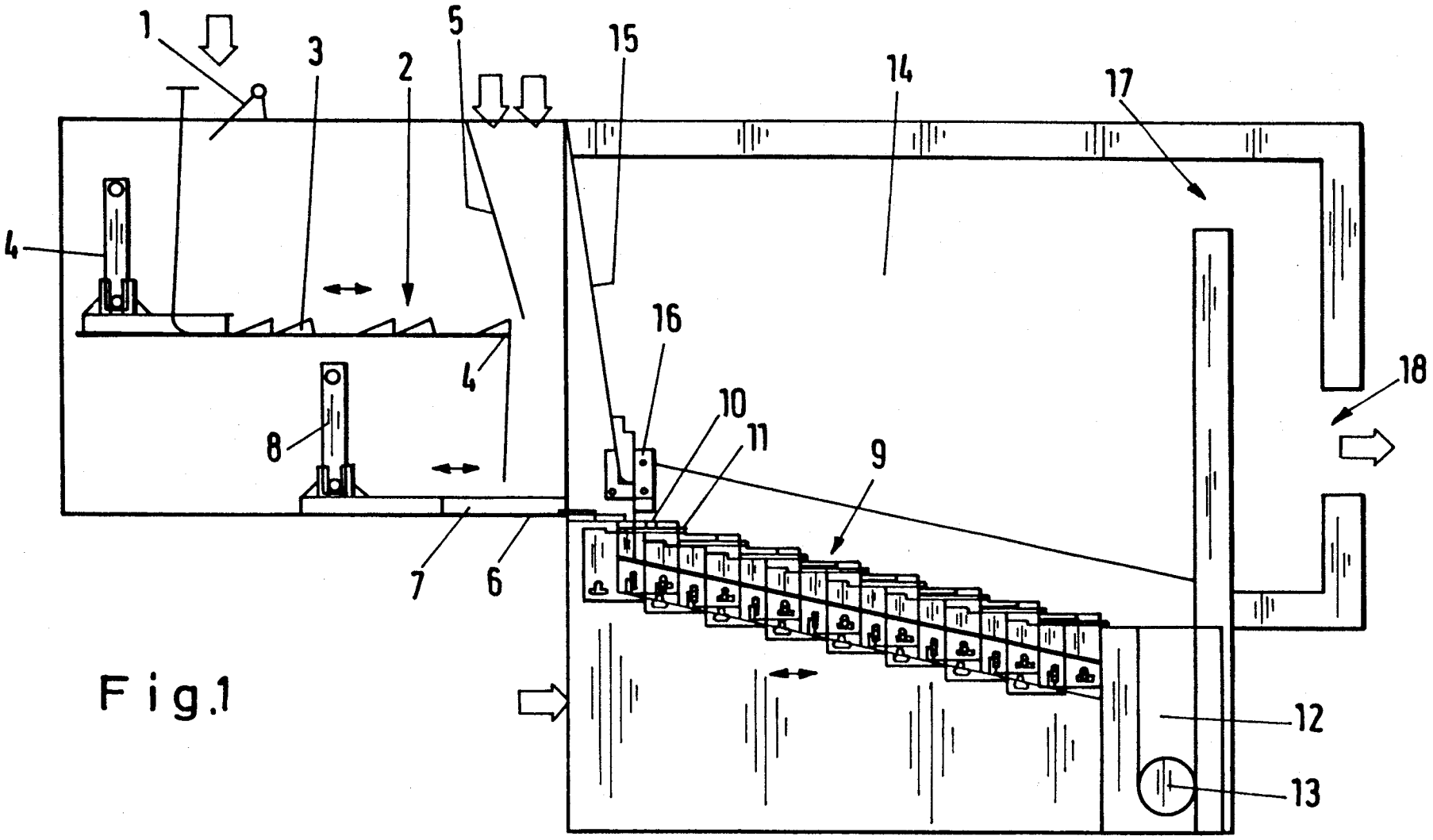
FIG. 1 shows a diagrammatic representation of a combustion furnace, in particular for trash.

In the preferred embodiment, as illustrated in FIG. 1, fuel is fed via a flap 1 arranged in the ceiling to the combustion furnace. Preferably, the fuel is homogeneously mixed with a basic additive, in order to bind acid formed by a neutralization reaction to give harmless salts. The fuel drops upon a pusher tray 2 which is provided with sawtoothed-shaped wedges 3, at least some of which are movable to and fro by a drive 4. Since the fuel can migrate over the shallow slope of the sawtoothed-shaped wedge 3, but is pushed forwards by the steep slope, the fuel migrates to the front edge 2(*a*) of the pusher tray and forces a flap 5 in swinging suspension to the side and drops upon a tray 6, on which a pusher ram 7 is moved to and fro by a drive 8. A basic additive in the liquid form can be added to the fuel lying on the tray 6 through the ceiling of the combustion furnace, as is indicated by the two arrows in FIG. 1. This addition is superfluous if a basic additive has been homogeneously added to the fuel beforehand.

The tray 6 is adjoined at the same height by the start of a grate 9 which consists of fixed plates 10 arranged stepwise and movable plates 11 arranged in between each pair of fixed plates. The movable plates 11 are shown in FIG. 1 in their moved-in position, in which they slightly overlap the fixed plate 10 arranged below them. By means of a back and forth movement, which is caused by the same drive 8 as for the pusher ram 7, the fuel is moved slopingly downwards on the grate 9 until it drops, completely burned, into an ash receiver 12, from which the ash is transported away, for example by means of a conveyor screw 13. The combustion chamber 14 arranged above the grate 9 is defined towards the tray 6 and the pusher tray 2 by a wall 15 which is mounted in a holder 16 slightly above the start of the grate. The combustion gases reach the exit 18 of the boiler through a passage 17 arranged underneath the ceiling. If the boiler walls are well insulated and have a high heat capacity and, if possible, can emit radiant heat, the space above the grate 9 can heat up to very high temperatures and cause pollutants contained in the combustion gases to be decomposed into harmless components. Heat exchangers, filters and the like can adjoin the exit 18 of the boiler.

Figure 2:
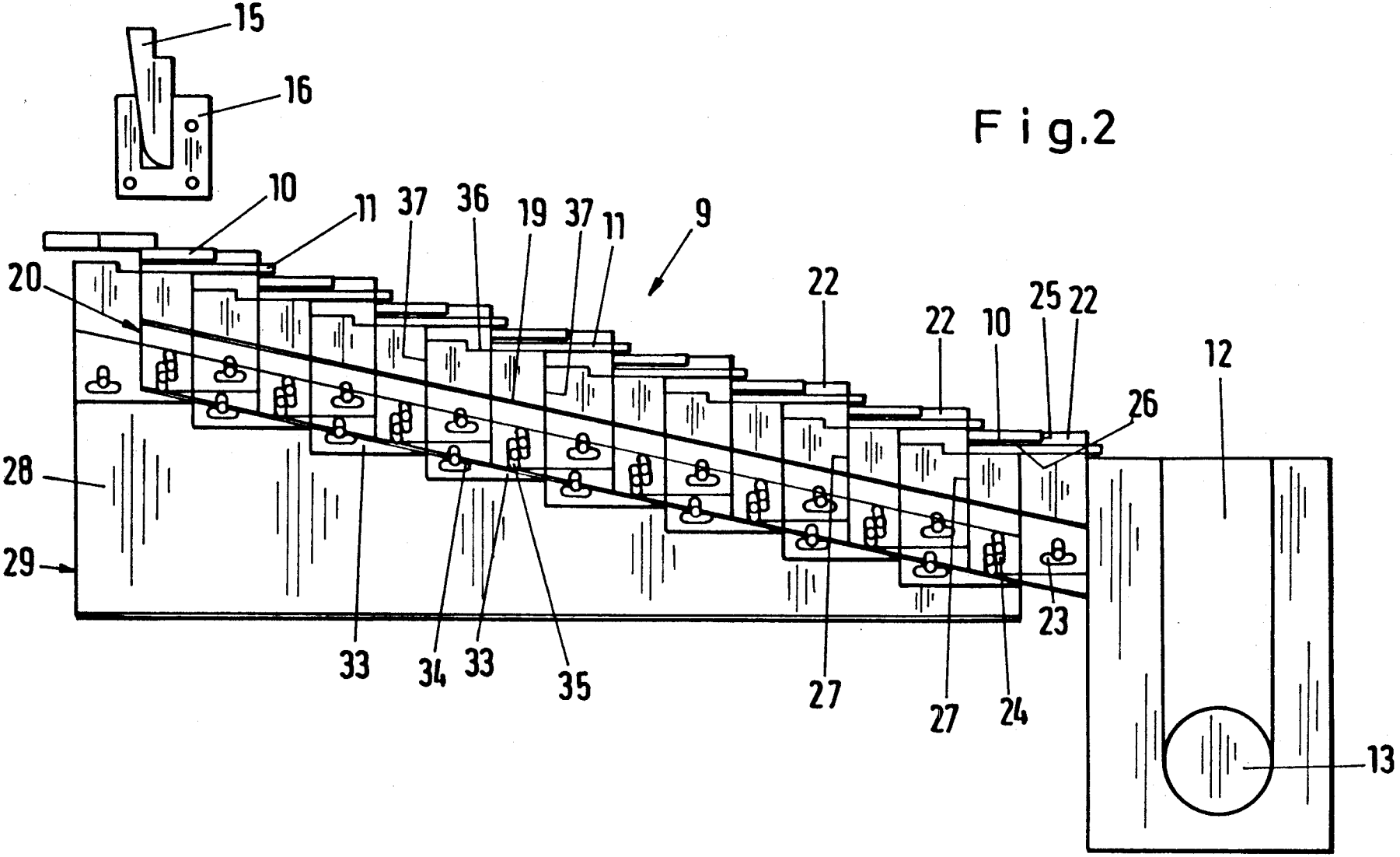
FIG. 2 shows a detail of a grate in the combustion furnace in FIG. 1.
Figure 4:
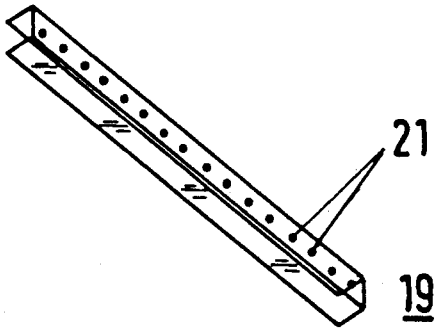
FIG. 4 shows a profile rail provided with bores for (one-sided) holding of the fixed plates.

The structure of the grate is explained below by reference to FIG. 2. The movable plates 11 extend like the fixed plates 10, over the entire width of the grate. Within this width, two U-shaped profile pieces 19 are arranged which function as the first common holder 20, namely for the fixed plates 10. A profile piece 19 in detail is shown in FIG. 4. It has eight pairs of holes 21, to each of which a plate-like support 22 is screwed. The plate-like supports 22 have two slots 23, 24, one of which is made T-shaped and thus makes adjustment in the vertical and horizontal directions possible. As a result of the screwing of the plate-like supports 22 into the slots 23, 24 thereof, the supports 22 are height adjustable on the first common holder 20. At their upper edge, the supports 22 have a stepping 25 which forms a recess 26 which is open towards the support 22 preceding in the direction of movement. The associated fixed plate 10 is placed into the recess 26 and thus rests on two vertical plate-like supports 22 arranged close to the opposite boiler walls. In FIG. 2, eight vertical plate-like supports 22 mutually adjoin one another tightly and form joints 27.

Figure 3:
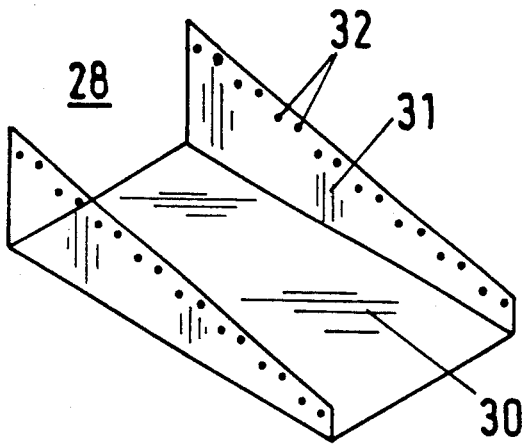
FIG. 3 shows a holder of U-shaped cross-section for the movable plates.

Within the first common holder 20, a channel member 28 of U-shaped cross-section is arranged, which forms the second common holder, namely for the movable plates The channel 28 is shown in detail in FIG. 3 and consists of a rectangular bottom 30 and two side walls 31, whose height decreases in the direction of movement correspondingly to the inclination of the grate 9. The side walls 31 are provided with mutually aligned pairs of bores 32. By means of each pair of bores 32, a vertical plate-like support 33 is fastened to the respective side wall 31 of the channel 28. Here too, the fastening is effected via pairs of slots 34, 35, so that the vertical supports 33 are height-adjustable. A movable plate 11, which is screwed to the support 33 by means of a fixing angle, is supported on the upper edges 36 thereof. The movable plates 11 are thus likewise held supported by two vertical plate-like supports 33, the spacing of the support points being somewhat smaller than the spacing of the support points for the fixed plates 10 based on the associated vertical supports 22. The vertical supports 33 also mutually adjoin one another tightly and form joints 37.

The air supply is effected within the U-shaped channel 28, namely by means of a reduced pressure generated above the grate 9, as a result of the air being drawn through and between the plates 10, 11. As a result of the air supply system effected by a reduced pressure, an extremely uniform air flow is generated which, if desired, can be controlled by different spacings between the plates 10, 11 at the end of the grate as compared with the start of the grate, in such a way that less than stoichiometric carbonization is effected at the start of the grate, while more than stoichiometric combustion is produced at the end of the grate. This arrangement does not result in an inadmissible increase in the fuel bed temperature, because the fuel is already largely converted to ash at the end of the grate, so that an increase in temperature cannot arise in spite of the excess combustion air available. The excess oxygen can promote, or make possible, the thermal decomposition of pollutants in the afterreaction chamber.

Figure 5:
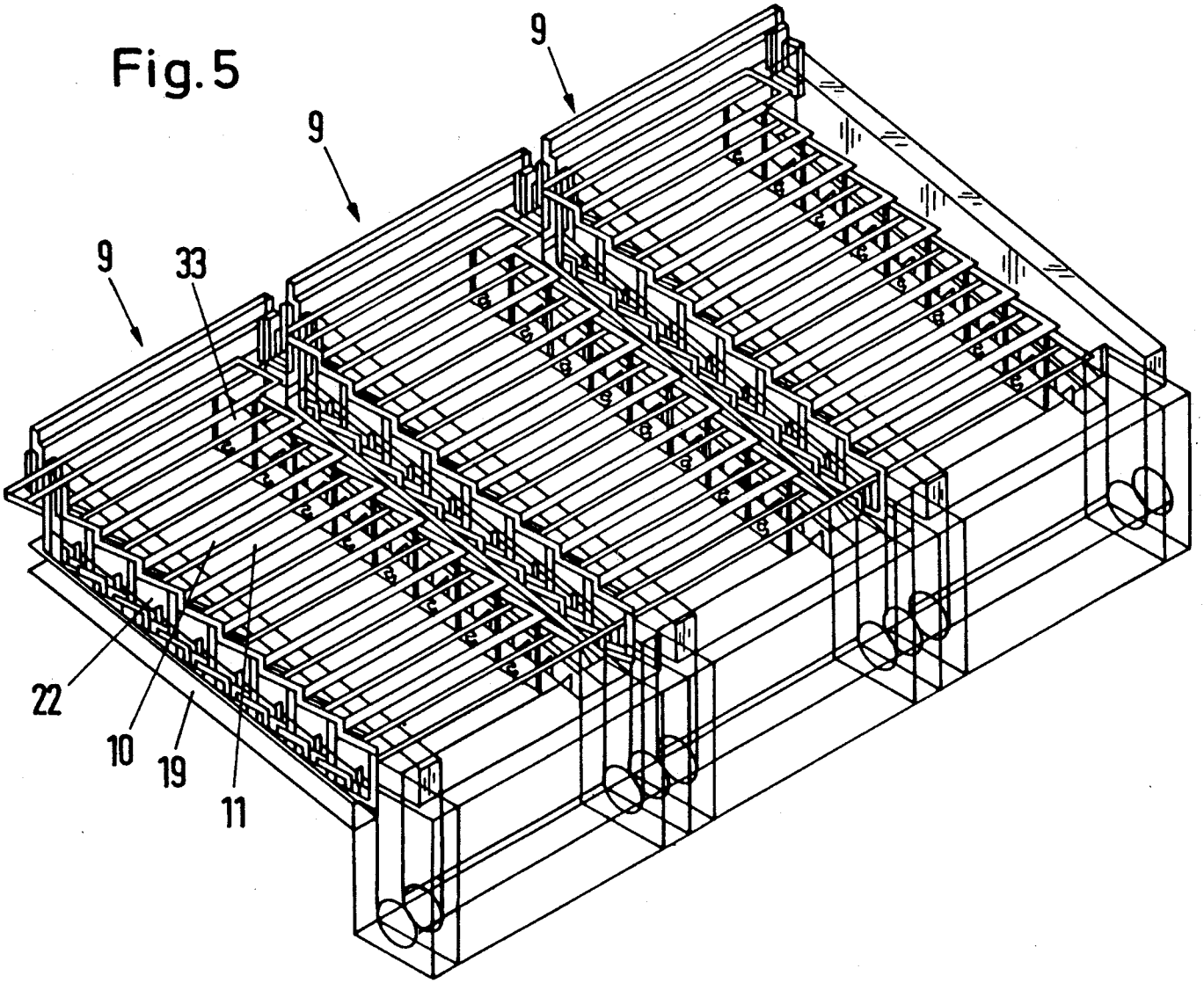
FIG. 5 shows a grate of large width, constructed from three individual grates according to FIG. 2, built up side by side.

Since the plates 10 and 11 as shown are supported only on two lines near the end of the plates by the edges of the vertical supports 22 and 33 respectively, only plates of a defined maximum length can be used, since otherwise there would be a risk of sagging of the plates 10 and 11 and hence undefined combustion air feeds. If a grate of greater width is to be used because of the desired capacity of the combustion furnace, the grate can be assembled from a plurality of individual grates 9, as is shown diagrammatically in FIG. 5. The plates 10, 11 of the individual grates 9 in the illustrative example 3 shown, can then complement each other without a significant interspace to give 15 the desired overall width of the grate, so that greater grate widths can also be accomplished without a risk of the plates 10, 11 sagging.

What is claimed is:

1. A grate for a fuel boiler having first and second ends and comprising:

a first holder;

a second holder;

a plurality of plates arranged in a cascading fashion, said plurality of plates comprising at least two plates fixedly attached to said first holder and a third movable plate attached to said second holder and disposed between said two fixed plates, said third plate being capable of reciprocating between said fixed plates;

drive means attached to said second holder for driving said third plate to reciprocate; and wherein said first and second fixed plates are vertically adjustable with respect to said first holder, and said third movable plate is vertically adjustable with respect to said second holder.

2. A grate for a fuel boiler as claimed in claim 1, wherein said movable plate is arranged to overlap both adjacent fixed plates.

3. A grate for a fuel boiler as claimed in claim 2, wherein said first holder further comprises at least two vertically positioned plate-like support members positioned one below the other and upon which said fixed plates are adjustably attached, and said second holder further comprises a vertically positioned plate-like support member upon which said movable plate is adjustably attached.

4. A grate for a fuel boiler as claimed in claim 3, wherein said second holder comprises a generally U-shaped channel having side and bottom walls, with the vertical support member being adjustably attached to said side walls.

5. A grate for a fuel boiler as claimed in claim 4, wherein said movable plate is adjustably attached to said vertical support member by screws.

6. A grate for a fuel boiler as claimed in claim 3, wherein said vertical support members of the first holder each has a stepped upper edge to form a recess therebetween for receiving the respective fixed plate.

7. A grate for a fuel boiler as claimed in claim 6, wherein a longitudinal edge of the first support member is offset from a longitudinal edge of the second support member and wherein said recess is open towards the longitudinal edge of the second support member in the direction of the cascade.

8. A grate for a fuel boiler as claimed in claim 3, wherein said vertical support members of said first holder are fixably attached to said vertical support members of said second holder, and wherein a supply of air is effected within said vertical support.

9. A grate for a fuel boiler as claimed in claim 3, wherein combustion air for said boiler flows exclusively through a space between said fixed and movable plates.

10. A grate for a fuel boiler as claimed in claim 9, wherein said combustion air is moved through said space by suction generated downstream of a firing chamber of said boiler.

11. A grate for a fuel boiler as claimed in claim 10, wherein said space between the plates is vertically adjustable for establishing a predetermined profile of air flow through the grate.

12. A grate for a fuel boiler as claimed in claim 11, wherein the height of said space progressively increases from said first to said second end of the grate.

13. A fuel boiler comprising:

a firing chamber;

a grate positioned above said combustion chamber, said grate having first and second ends and comprising a first holder, a second holder, a plurality of plates arranged in a cascading fashion, said plurality of plates comprising at least two plates fixedly attached to said first holder and a third movable plate attached to said second holder, said third plate being capable of reciprocating between said fixed plates;

drive means attached to said second holder of the grate for driving the third movable plate to reciprocate; and wherein said first and second fixed plates of the grate are vertically adjustable with respect to said first holder, and said movable plate is vertically adjustable with respect to said second holder.

14. A fuel boiler as claimed in claim 13, wherein combustion air exclusively passes through an interspace between the first and second plates and the movable third plate.

15. A fuel boiler as claimed in claim 14, wherein the combustion air is moved through the interspace by a source of suction arranged downstream of the firing chamber.

16. A fuel boiler as claimed in claim 15, wherein the height of said interspace is vertically adjustable for establishing a predetermined profile of air fuel through the grate.

17. A fuel boiler as claimed in claim 16, wherein the height of each interspace progressively increases from said first to said end of the grate.

18. A fuel boiler as claimed in claim 17, wherein said boiler further comprises a feed tray positioned at the first end of the grate for feeding fuel to the grate.

19. A fuel boiler as claimed in claim 18, wherein said boiler includes decomposition means for causing pollutants contained in the combustion gases to be decomposed into harmless components.

* * * * *